United States Patent [19]

Sakata et al.

[11] 4,350,225

[45] Sep. 21, 1982

[54] ELEVATOR CONTROL SYSTEM

[75] Inventors: Kazuhiro Sakata; Takeo Yuminaka; Masao Nakazato; Kenji Yoneda, all of Katsuta; Soshiro Kuzunuki; Yasunori Katayama, both of Hitachi, all of Japan

[73] Assignee: Hitachi, Ltd., Tokyo, Japan

[21] Appl. No.: 117,088

[22] Filed: Jan. 31, 1980

[30] Foreign Application Priority Data

Feb. 2, 1979 [JP] Japan ..... 54/10431

[51] Int. Cl.[3] ..... B66B 5/02

[52] U.S. Cl. ..... 187/29 R; 371/9

[58] Field of Search ..... 187/29; 371/9, 12, 62

[56] References Cited

U.S. PATENT DOCUMENTS

| | | | |
|---|---|---|---|
| 3,786,433 | 1/1974 | Notley et al. | 371/62 X |
| 4,044,337 | 8/1977 | Hicks et al. | 371/12 X |
| 4,153,198 | 5/1979 | Eki et al. | 371/9 |
| 4,210,226 | 7/1980 | Ichioka | 187/29 |

FOREIGN PATENT DOCUMENTS

| | | | |
|---|---|---|---|
| 2217665 | 10/1973 | Fed. Rep. of Germany | 371/9 |
| 52-37741 | 3/1977 | Japan | 371/9 |

*Primary Examiner*—J. V. Truhe
*Assistant Examiner*—W. E. Duncanson, Jr.
*Attorney, Agent, or Firm*—Craig & Antonelli

[57] ABSTRACT

A control logic for an elevator servicing a plurality of floors of a building comprises two microcomputers. The two microcomputers are provided with abnormal state detectors of their own. When the abnormal state detector of one microcomputer is actuated, the elevator is operated for recovery to the nearest floor by the other microcomputer on the condition that the abnormal state detector of the other microcomputer is not actuated, and thereafter retrial for the abnormal microcomputer is effected by an instruction from the other microcomputer. When the abnormal microcomputer recovers to normal state by the retrial, the elevator keeps operating, thereby preventing such a problem that the elevator cannot continue service by erroneous operation due to noise.

20 Claims, 12 Drawing Figures

ELEVATOR CONTROL SYSTEM

This invention relates to an elevator control system wherein a control logic for elevator cars advantageously comprises a plurality of computers.

Development of semiconductor technology has promoted contactless control systems for elevators. In particular, recent development of semiconductor integrated circuit technology has advanced LSI circuit art which has taken part in the advent of microcomputers. Then, a control logic, i.e., a component unit of an elevator control system which performs a sequential processing of the elevator control has been planned to incorporate a digital computer and practised accordingly in some applications. However, as far as the microcomputer is concerned, almost all the functional parts as a computer are integrated in a single chip with the result that it is impossible, although possible with a conventional computer, to incorporate a circuit for detecting interior failures of the microcomputer in order to watch and control safe operation of the whole system. Therefore, the control logic of the microcomputer type has not yet met the fail safe requirements application to a transporter such as an elevator which vertically transports passangers and is not fully applied to this field at present.

Additionally and more specifically, in the event of failure of the single chip element, direct failure of the whole system results. If such an accident occurs during operation of the elevator, passengers will be trapped in the elevator car or jammed therein and greatly depressed. With the conventional random logic, the failure partly turns down the necessary functions but will not override the whole system so that upon a jam, the system can not operate immediately to cause the elevator car to drop to the nearest floor at which the car door is opened for rescue of the passengers. With the microcomputer logic, however, all the functions become out of order, thus preventing the rescue operation set forth above. Incidentally, the advanced semiconductor integrated circuit technology provides availability of microcomputers at low cost. By making use of the low cost of microcomputers, an approach has been made to a system wherein two microcomputers are provided of which one is auxiliary used and ready for switchover in the event of failure of the other microcomputer (Japanese patent application laid-open No. 8350/1979).

A problem characteristic to the microcomputer used for the elevator control system arises from ambient conditions. It is a rule to locate the microcomputer at a temperature-variation-free and noise-free site. Nevertheless, the elevator control system is usually built in a control board along with such a large power circuit as for an elevator drive motor. This ambient condition is full of noise, especially involving an extremely large noise occurring each time the elevator starts to operate, and also may be transiently affected by temperature variations depending on operation time of the elevator. Accordingly, the low-voltage driven microcomputer is adversely affected in this ambient condition and at the extremity, frequent erroneous operation of the microcomputer due to the noise would result though the microcomputer itself is normal. Complete noise elimination in both the large power circuit and the microcomputer leads to a very expensive control system and it is difficult to cope with irregular spike noise which occurs when a plurality of elevators start to operate simultaneously.

To handle such noise problems, it has been proposed to temporarily open the power supply circuit when a abnormal state of the elevator control microcomputer is detected and to close the power supply circuit after a predetermined time (Japanese patent application laid-open No. 115048/1977). However, it cannot be predicted what the state the elevator will have when abnormal the state of the microcomputer is detected, and hence the unconditional opening and closing of the power supply circuit cannot be a complete solution.

An object of this invention is to provide a highly reliable elevator control system of the type comprising a microcomputer control logic and which can reduce the inoperative time in the event of erroneous operation.

Another object of this invention is to provide an elevator control system which can ensure highly safe operation in the event that a microcomputer of a control logic becomes abnormal.

According to an aspect of the present invention, there is provided an elevator control system comprising an elevator servicing a plurality of floors in a building, and a control logic for the elevator including digital computers, wherein the control logic comprises a plurality of computers, and at least one computer is provided with means for initializing the other computers.

The above and other objects, features and advantages of this invention will become clearer from the following description with reference to the accompanying drawings, in which:

FIGS. 1 to 5 show the construction of an elevator control system embodying the invention wherein, FIG. 1 is a block diagram to show the overall construction of the elevator control system;

FIG. 2 is a block diagram to show the construction of a microcomputer;

FIG. 3 is a circuit diagram to show the construction of an input/output signal switching unit;

FIG. 4 is a circuit diagram of an abnormal state detector circuit; and

FIG. 5 is a circuit diagram of a retrial circuit;

Figure 6:
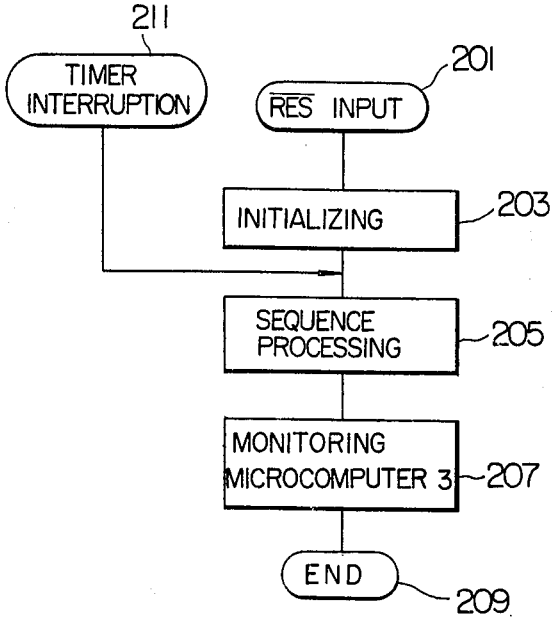
Figure 7:
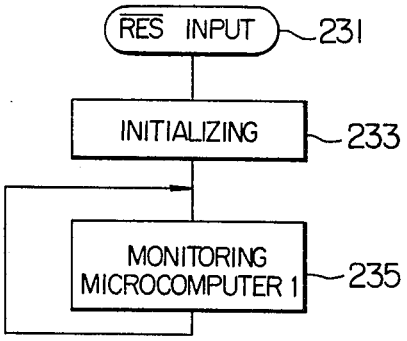
Figure 8:
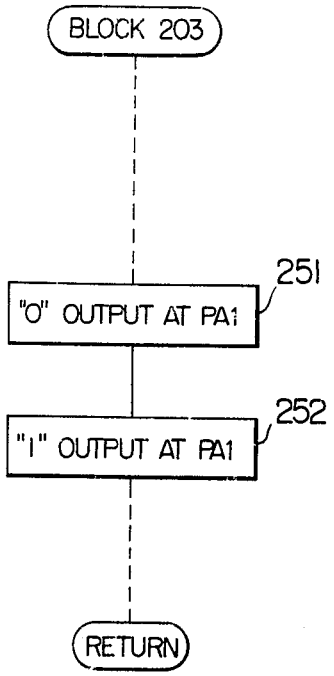
Figure 9:
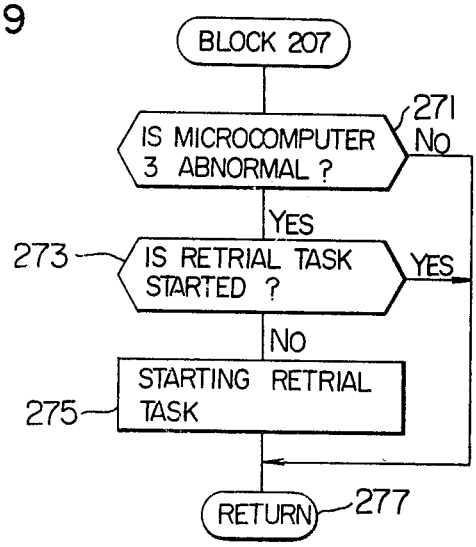
Figure 12:
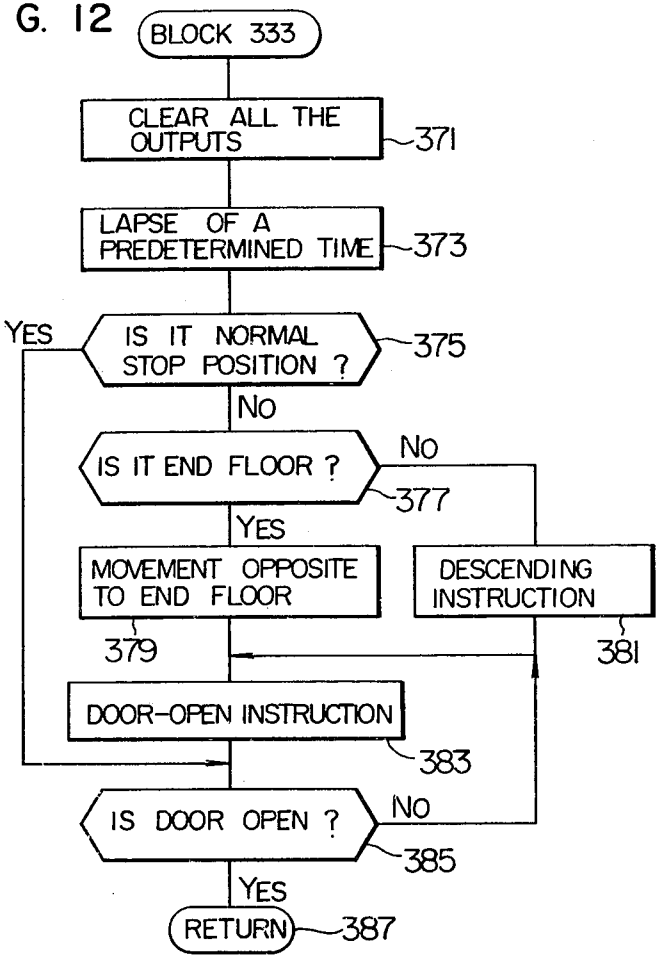
Figure 10:
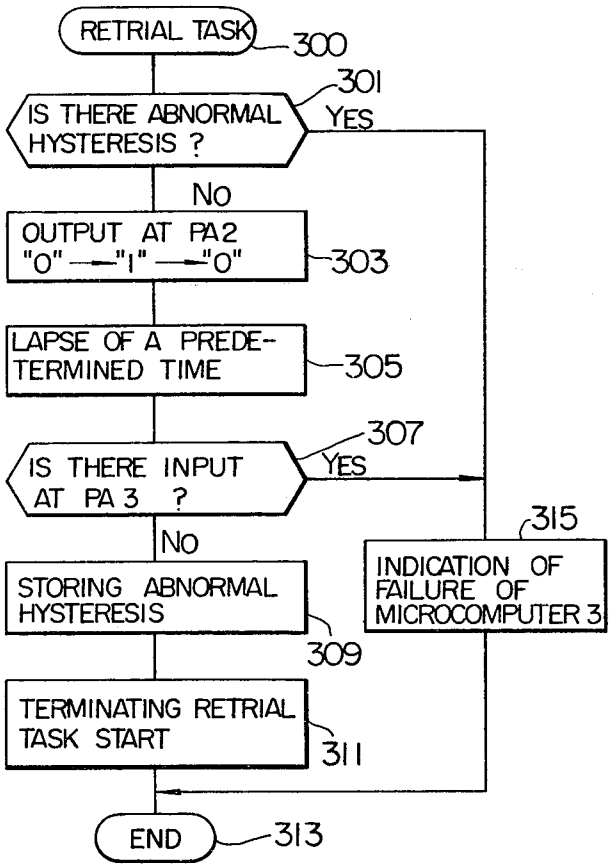
Figure 11:
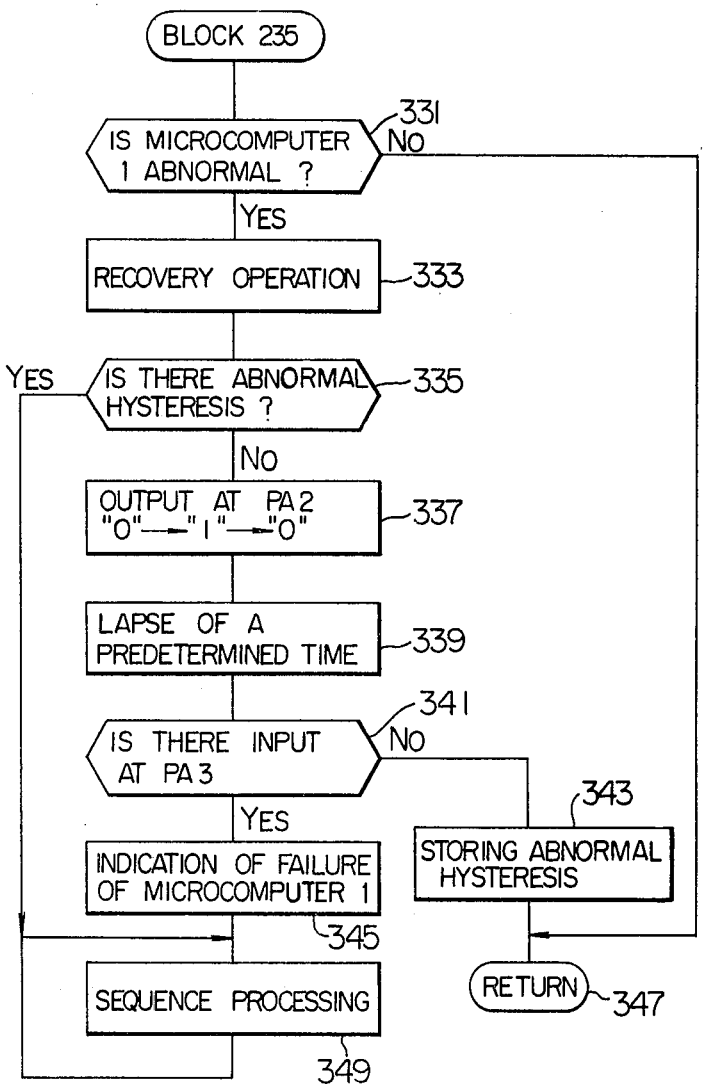

FIGS. 6 to 12 diagrammatically show operation of the elevator control system according to the invention wherein, FIG. 6 is a flow chart to explain the fundamental operation of a microcomputer 1;

FIG. 7 is a flow chart to explain the fundamental operation of a microcomputer 3;

FIG. 8 is a flow chart to detail an initializing task of the microcomputer 1;

FIG. 9 is a flow chart to detail a sequence task of the microcomputer 1;

FIG. 10 is a flow chart to detail a retrial task of the microcomputer 1;

FIG. 11 is a flow chart to detail a monitoring task of the microcomputer 3; and FIG. 12 is a flow chart to detail a recovery operation task of the microcomputer 3.

The present invention will now be described by way of a preferred embodiment with a control logic having a plurality of microcomputers, especially two, but the number of microcomputers exemplified herein is only for simplicity of explanation. The invention may also be applicable to a system wherein a plurality of elevators have each a microcomputer, a system wherein a controller for a plurality of elevators has a microcomputer and respective elevators are also provided with a microcomputer, and a system which includes a microcomputer used for other purposes than elevator controlling.

An elevator control system embodying the invention is diagrammatically shown in FIGS. 1 to 5 and detailed in operation with reference to FIGS. 6 to 12.

Figure 1:
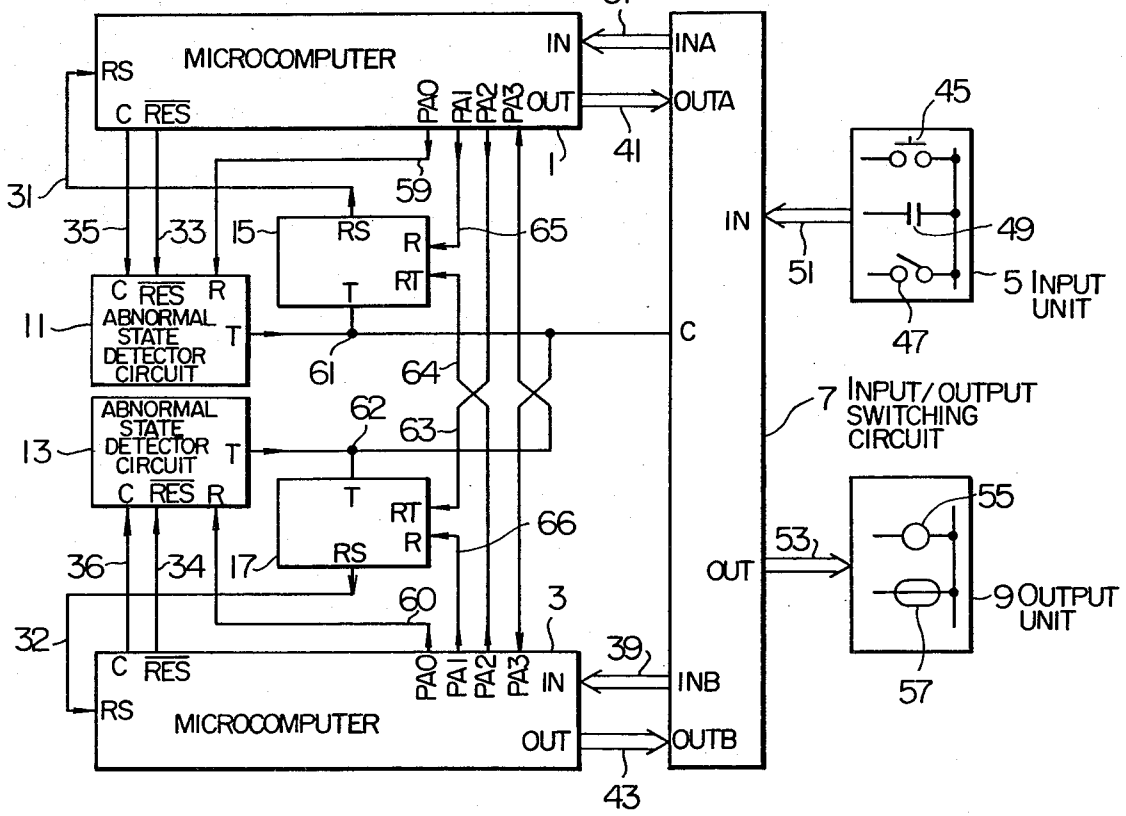

Referring now to FIG. 1 showing in block form the overall construction of one embodiment of the invention, the embodied elevator control system comprises a dual system including microcomputers 1 and 3. The microcomputers 1 and 3 receive inputs from an input unit 5 via an input/output switching circuit 7. Outputs of the microcomputers 1 and 3 are reverted to an output unit 9 via the switching circuit 7. The microcomputers 1 and 3 are also connected with abnormal state detector circuits 11 and 13 for detecting abnormal state of the microcomputers 1 and 3 and retrial circuits 15 and 17 for initializing when the microcomputers 1 and 3 become abnormal.

As detailed hereinafter, the microcomputers 1 and 3 have the same construction in this embodiment and will be referred to simultaneously, if necessary, with reference numerals or characters representative of the microcomputer 3 and its associated elements parenthesized. The microcomputer 1(3) has an input terminal RS for receiving an external initializing signal. When the input terminal RS is supplied with a signal from an output terminal RS of the retrial circuit 15(17), all the registers contained in the microcomputer 1(3) are set to the initial state and at the subsequent disappearance of the signal on the input terminal RS, the microcomputer 1(3) starts to operate. The initializing signal is amplified in the microcomputer 1(3) and delivered out of an output terminal $\overline{\text{RES}}$. The output terminal $\overline{\text{RES}}$ is connected to an input terminal $\overline{\text{RES}}$ of the abnormal state detector circuit 11(13) via a signal line 33(34). The microcomputer 1(3) has an internal, reference clock which governs all the operations of the microcomputer 1(3). A portion of the clock signal is supplied from an output terminal C to an input terminal C of the abnormal state detector circuit 11(13) via a signal line 35(36). The microcomputer 1(3) has terminals IN, OUT, PA0, PA1, PA2, and PA3 which are used for delivery of operation outputs and reception of signals necessary for the operation. The input terminal IN is connected to an output terminal INA (INB) of the switching circuit 7 via a signal line 37(39). The output terminal INA and INB have connections, internally of the switching circuit 7, to an input terminal IN, but in accordance with the absence and presence of a signal at an input terminal C, a signal at the input terminal IN is switched to the output terminal INA and the output terminal INB, respectively. This switching relation holds true for the connection of an output terminal OUT in respect of input terminals OUT A and OUT B which is performed simultaneously with the connection of the input terminal IN in respect of the output terminals INA and INB. The input terminals OUT A and OUT B are connected to output terminals OUT of the microcomputers 1 and 3 via signal lines 41 and 43, respectively. The signal lines 37, 39, 41 and 43 are not of a single conductor but consist of a plurality of conductors. Applied via a signal line 51 to the input terminal IN of the switching circuit 7 are signals of the input unit 5 which are generated by a push button switch 45 for movement of the elevator, a switch 47 and a contactor 49 associated with a speed controller, respectively. The output of the microcomputer 1(3), on the other hand, is sent to the output unit 9 via the output terminal OUT and a signal line 53 so as to enable an indication lamp 55 (including a microcomputer failure indication lamp) and a relay 57 for generating a contact signal to be applied to the speed controller. The signal lines 51 and 53 consist of a plurality of conductors. The output terminal PA0 of the microcomputer 1(3) is connected to an input terminal R of the abnormal state detector circuit 11(13) via a signal line 59(60). The circuit 11(13) drives a counter by receiving a reference signal on the input terminal C and produces an abnormal signal at an output terminal T after a predetermined time. Normally, however, the counter is reset by a reset signal from the terminal PA0 of the microcomputer 1(3) to prevent production of the output at the terminal T. In other words, if the microcomputer 1(3) operates erroneously under the influence of the ambient noise and runs away, the signal to be supplied to the terminal R disappears so that the counter is allowed to operate to thereby produce the abnormal or failure signal. The abnormal state detector circuit 11 comprises a so-called watch dog timer. An output signal line 61 from the detector circuit 11 is connected to the terminal C of the switching circuit 7. An output signal line 62 from the other detector circuit 13 does not terminate in the switching circuit 7. The output terminal T of the abnormal state detector circuit 11(13) is also connected to an input terminal T of the retrial circuit 15(17). The circuit 15(17) stores a signal received at the input terminal T. Under this condition, when a retrial instruction signal from the output terminal PA2 of the microcomputer 3(1) is applied to an input terminal RT via a signal line 64(63), a retrial signal is sent from the output terminal RS to retry the microcomputer 1(3). Since the retrial instruction signal from the microcomputer 3(1) is programmed to disappear after a predetermined time, the microcomputer 1(3) starts to operate after this time lapse. At the beginning of the operation, the microcomputer 1(3) executes first an initializing program and at the same time, a signal from the output terminal PA1 is sent to an input terminal R via signal line 65(66) to release the storage in the retrial circuit 15(17). To ensure that the microcomputer 1(3) starts to operate with the initializing program, the signal produced on the signal line 61(62) is received by the input terminal PA3 of the microcomputer 3(1) which in turn transmits the retrial instruction signal.

Figure 2:
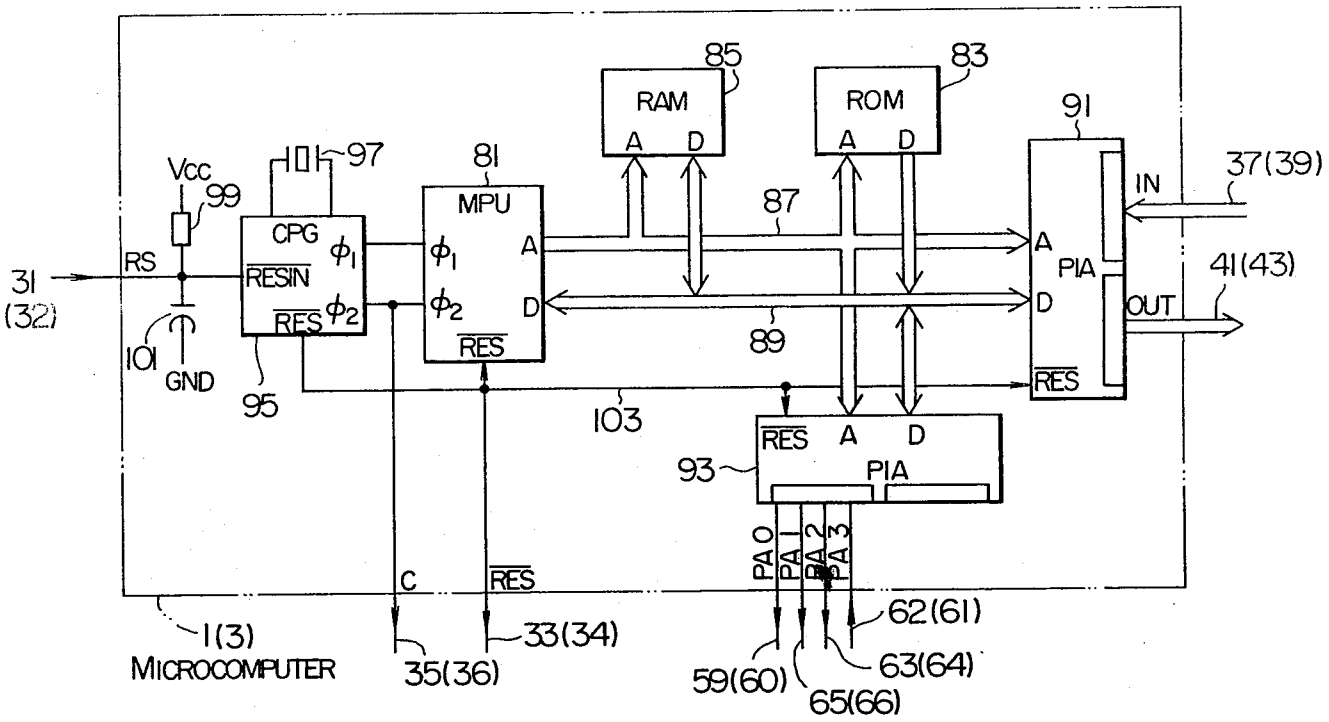

To detail blocks in FIG. 1, reference is first made to FIG. 2 which illustrates details of the microcomputer 1(3). At present, various types of microcomputer designed for various uses are put on market. In this embodiment, a microcomputer of HMCS 6800 system made by Hitachi, Ltd. is suitably adapted to the elevator control system. Other types of microcomputer may of course be utilized for attaining effect and operation of the present invention. For simplicity of explanation, LSIs are to be identified by their types and not detailed. The heart of the microcomputer 1 or 3 is a MPU (Microprocessing Unit) 81 in the form of HD 48000 D of the HMCS 6800. The MPU 81 operates by receiving clock signals at input terminals $\phi_1$ and $\phi_2$. All the registers in the MPU 81 are set to the initial value by receiving a signal at an input terminal $\overline{\text{RES}}$ and in synchronism with disappearance of this signal, the MPU 81 starts to execute a designated program. The program is stored in an ROM (Read only memory) 83 in the form of HN 46830A and HN 42 of the HMCS 6800, and temporary data used for operation are stored in an RAM (Random access memory) 85 in the form of HM46810A of the HMCS 6800. An address bus 87 and a data bus 89 interconnect the ROM 83, RAM 85 and MPU 81. For input/output exchange of the microcomputer 1(3), PIAs (Peripheral interface adapter) 91 and 93 in the form of HD 46821 of the HMCS 6800 are also connected to the buses 87 and 89. The PIA 91 comprises an input terminal IN for receiving data from the input unit 5 and an output terminal OUT for feeding the output unit 9. The PIA 91 has eight input/output terminals for A-ports and eight input/output terminals for B-ports. But in case where either A-ports or B-ports is used, for example, the input unit 5 and output unit 9 may be individually addressed, and then receive the input or deliver the output as well known in the art. The PIA 93 is connected with the output terminals PA0, PA1 and PA2 and the input terminal PA3. As exemplified herein, the PIAs 91 and 93 have the input and output terminals in the form of an LSI which can be freely altered to act as the input terminal or the output terminal in accordance with a desired program. In the event that the program is disturbed or in an abnormal state, however, the contents of the input and output register (data direction register) of the PIA may be changed by the abnormal state. Under this condition, if the terminal which has been set to act as the input terminal is changed to the output terminal, this change adversely affects the other elements. Namely, since there exist two output points in one signal line, signal transmission is prevented and besides, delivery of the discrepant signal breaks down the output element. In this embodiment, there is provided, between the input unit 5 and the microcomputer, the switching circuit 7 which acts to prevent these troubles. Thus, the switching circuit 7 is switched by the signal from the abnormal state detector circuit 11 so that even when the input terminal of the microcomputer 1 changes to act as the output terminal by accident, there occurs no trouble. In this manner, it is possible to prevent the output terminal of the input unit 5 from being broken down and at the same time to supply the correct input signal to the microcomputer 3. The PIAs 91 and 93 also have input terminals $\overline{RES}$ to which a signal is applied when power is turned on so as to reset all the internal registers.

A CPG (Clock pulse generator) 95 in the form of HD 26501 of the HMCS 6800 is adapted to supply clock signals to the input terminals $\phi_1$ and $\phi_2$ of the MPU 81. A crystal resonator 97 is connected to the CPG 95 to generate the clock signals. The CPG 95 has an input terminal $\overline{RESIN}$ to which a junction of a series connection of a resistor 99 and a capacitor 101 between power supply and ground is connected. The input terminal $\overline{RESIN}$ is also connected to the input terminal RS. When power is turned on in the absence of the signal at the input terminal RS, voltage at the input terminal $\overline{RESIN}$ increases in accordance with a time constant which is determined by resistor 99 and capacitor 101 until it reaches a predetermined value at which the clock signals are generated from the output terminals $\phi_1$ and $\phi_2$. During a period ranging from the closure of the power supply circuit to the generation of the clock signals, the CPG 95 operates to feed a signal from an output terminal $\overline{RES}$ to the input terminals $\overline{RES}$ of the MPU 81, PIAs 91 and 93 and the output terminal $\overline{RES}$ of the microcomputer via a signal line 103, thereby setting individual LSIs to the initial value. The clock signal from the output terminal $\phi_2$ is also supplied to the output terminal C of the microcomputer.

Figure 3:
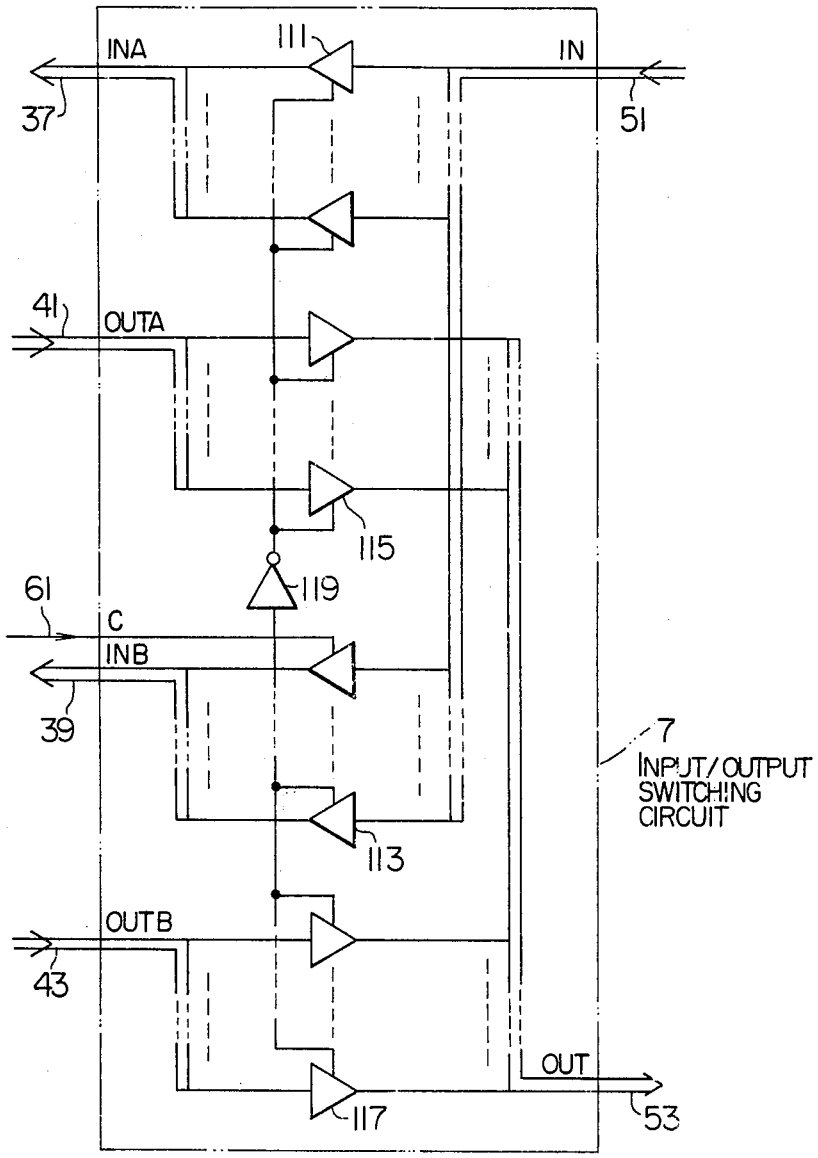

FIG. 3 shows details of the switching circuit 7. The signal from the input unit 5 is applied in parallel via the signal line 51 and the input terminal IN to an input block comprised of TSGs (Tri-state gate) 111 associated with the microcomputer 1 and TSGs 113 associated with the microcomputer 3. The "Tri-state gate" bears a high output impedance in the absence of a gate control input signal and when receiving the gate control input signal, directly transmits therethrough its input signal to its output terminal. The output of the TSG 111 is delivered out of the output terminal INA and the output of the TSG 113 is delivered out of the output terminal INB. The output of the microcomputer 1 is connected to TSGs 115 via the input terminal OUT A and the output of the microcomputer 3 is connected to TSGs 117 via the input terminal OUT B. The TSGs 115 and TSGs 117 are connected in parallel to be coupled with the output unit 9 via the output terminal OUT. In the absence of the signal at the input terminal C, the TSGs 113 and 117 bear the high output impedance to prevent not only signal transmission to the output terminal INB but also signal transmission from the input terminal OUT B to the output terminal OUT. On the contrary, because of the provision of a NOT element 119 whose output is connected to the control gates of the TSGs 111 and 115, the input to the microcomputer 1 and the output therefrom can be transmitted through the TSGs 111 and 115. As described above, the TSGs 111 and 113 interposed between the input unit 15 and the microcomputers 1 and 3 can bear the high output impedance when the abnormal signal is present on the signal line 61. Accordingly, even when one microcomputer runs away causing the change between input and output, it is possible to protect the element from being damaged and the eliminate adverse affect on the input signal to the other microcomputer. In the presence of the abnormal signal, the above condition is reversed so that the input unit 5 and the output unit 9 are communicated with the microcomputer 3 via the TSGs 113 and 117.

Figure 4:
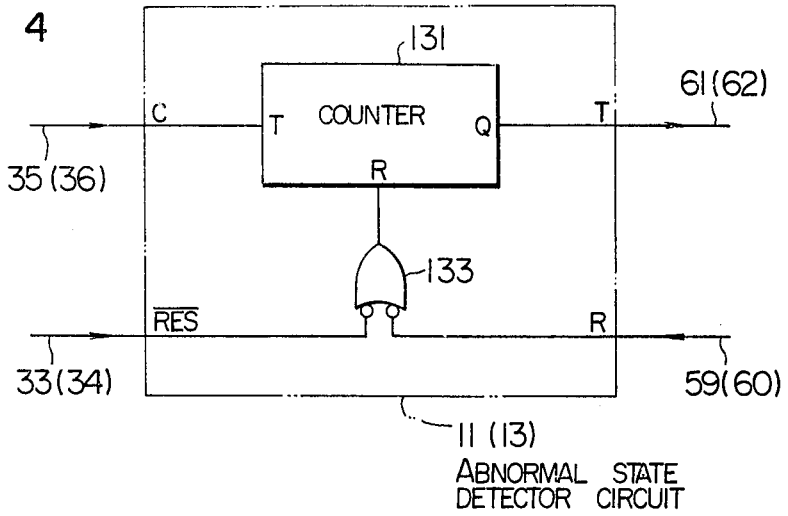

FIG. 4 shows details of the abnormal state detector circuits 11 and 13. The clock signal normally fed from the microcomputer 1(3) to the input terminal C is relayed to an input terminal T of a multi-stage counter 131. The counter 131 starts to count by this signal and when counting up to the last stage, it produces from an output terminal Q an output signal which in turn is passed onto the signal line 61(62) via the output terminal T. The counter 131 has a reset input terminal R connected to a NAND element 133. One input of the NAND element 133 is connected to the input terminal $\overline{RES}$ so that all the stages of the counter 131 can be reset when the signal from the microcomputer 1(3) is present on the signal line 33(34). The other input is connected to the input terminal R to ensure that the counter 131 can be reset by the signal present on the signal line 59(60). Operation of the abnormal state detector circuit has already been described hereinbefore.

Figure 5:
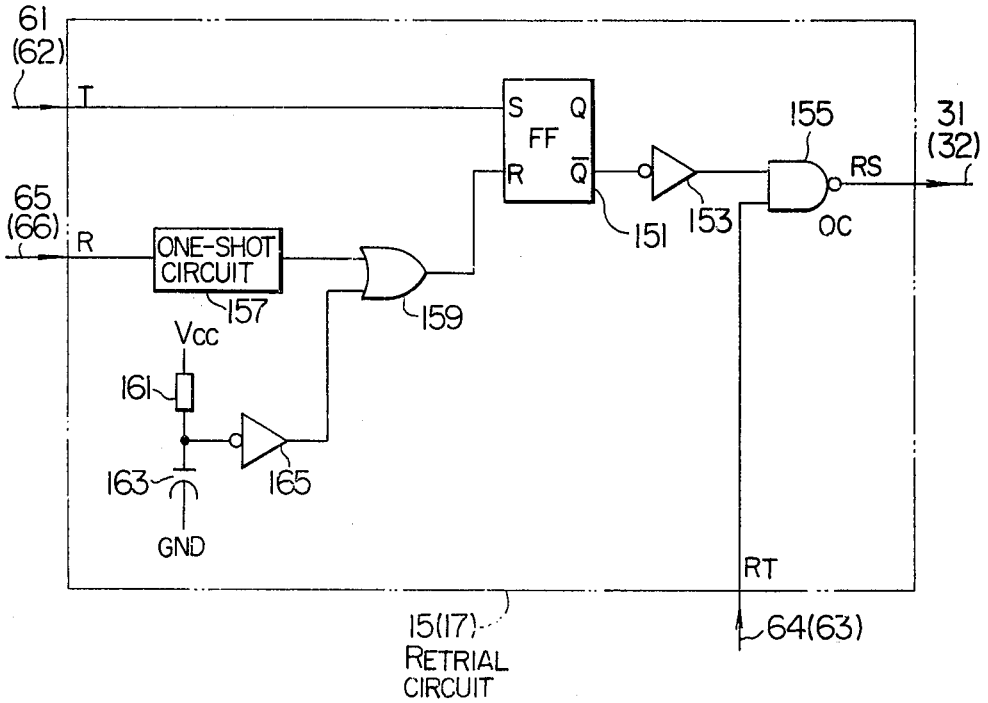

FIG. 5 shows details of the retrial circuits 15 and 17. When the signal is present on the output signal line 61(62) of the abnormal state detector circuit 11(13), this signal is coupled to an S (set) input terminal of a reset preferential FF (flip-flop) 151 and stored therein. An output $\overline{Q}$ then bears logic "0" and is inverted into logic "1" via a NOT element 153. If, on the other hand, the retrial instruction signal from the other microcomputer 3(1) is received by the input terminal RT via the signal line 64(63), an open collector type NAND element 155 is supplied with two inputs so that an open collector output transistor of the NAND element 155 is turned on to thereby connect the output terminal RS to ground. Consequently, the capacitor 101 shown in FIG. 2 discharges and the signal at the terminal $\overline{\text{RESIN}}$ of the CPG 95 disappears, thus causing the output terminal $\overline{\text{RES}}$ to produce the initial value setting signal. Since this signal is received by the abnormal state detector circuit 11(13) via the signal line 33(34), the counter 131 is reset to nullify the signal which is sent from the output terminal T of the counter 131 to the set input terminal S of the FF 151 of FIG. 5 via the signal line 61(62). Thereafter, if the other microcomputer 3(1) stops sending the signal on the signal line 64(63), the output transistor of the NAND element 155 is turned off. By the nature of the open collector type output transistor, the input terminal RS of FIG. 2 is disconnected from the signal and the capacitor 101 begins to recharge until it reaches the predetermined voltage at which the microcomputer 1(3) again starts initializing as described hereinbefore. The open collector type element used in this circuit contributes to reduce the capacitance of the capacitor 101. In an ordinary logic element were used, its output resistance would be small and an expensive, large-capacitance capacitor would be required for obtaining the predetermined time constant. In this way, the common initializing operation is used for both the abnormal state detection and the closure of power supply, thereby ensuring an inexpensive and reliable circuit construction.

The initializing program is so designed that a change of logic form "0" to "1" is delivered out of the output terminal PA1 of the microcomputer 1(3). As a result, this signal is supplied to a one-shot pulse circuit 157 via the input terminal R of FIG. 5. The circuit 157 then produces an output for a predetermined time and this output is coupled with a reset input R of the FF 151 via an OR element 159 to erase the storage in the FF 151. Accordingly, there occurs no retrial by means of the subsequent signal from the microcomputer 3(1). More particularly, even when the other microcomputer runs away and the retrial instruction signal is present on the signal line 63 or 64, this instruction signal is rejected because no output is produced from the NOT element 153 unless the one partner microcomputer is in abnormal state. Therefore, there occurs no erroneous retrial.

Also, since the output of the abnormal state detector circuit 11(13) has been stored in the FF 151 of the retrial circuit 15(17) before it is reset by the microcomputer 1(3) which is in abnormal state, the steady retrial can be attained in the event of occurrence of the abnormal state. More particularly, when the retrial instruction signal from the other microcomputer 3(1) is received and the signal is produced from the output terminal RS, the CPG 95 produces the signal from the outpt terminal $\overline{\text{RES}}$ to reset the counter 131. This in turn erases the abnormal output and the output from the terminal RS as well. As a result, factors to cause unstable operation such as insufficient time for delivery of the signal from the terminal $\overline{\text{RES}}$ of the CPG 95 and consequent insufficient time for start of the MPU 81 can be eliminated and steady operation can be ensured. In addition, the FF 151 is reset by the microcomputer which is in abnormal state so that the operation of the retrial circuit 15 can advantageously be repeated infinitely unless the MPU 81 is started steadily.

The one-shot pulse circuit 157 is adapted to assure the steady retrial in the event of occurrence of the abnormal state. More particularly, in some abnormal states in which the program is disturbed, the signal is possibly latched on the signal line 65(66). In such an event, unless the one-shot pulse circuit 157 is provided, the FF 151 will keep being reset, making it impossible to effect the retrial from the other microcomputer. The one-shot pulse circuit 157 provided in this embodiment assures, even in such an instance, the temporary production of the reset pulse to prevent continuity of reset state of the FF 151. In this manner, the steady retrial can be ensured even in the event of repetitions occurrence of the abnormal state.

The retrial circuit as shown in FIG. 5 further comprises a series connection of a resistor 161 and a capacitor 163 between power supply and ground, and a junction of the series connection is coupled with a NOT element 165. The output of the NOT element 165 is coupled with the other input of the OR element 159. Thus, the FF 151 can be reset by this circuitry upon the closure of the power supply circuit. More particularly, by designing a time constant of the resistor 161 and capacitor 163 so as to be sufficiently larger than a rise time of power supply voltage, the NOT element 165 can receive a logic "0" input during only the differential time to produce a logic "1" output for resetting the FF 151. For further description in general, if the FF 151 has a storage before the closure of power supply and the other input (input terminal RT) of the NAND element 155 is supplied with the signal, the output terminal RS bears logic "0" so that the capacitor 101 connected to the terminal $\overline{\text{RESIN}}$ of the CPG 95 will not be charged to thereby prevent initializing and starting of the microcomputer. But, the circuitry mentioned above acts to reset the FF 151 and hence the terminal RS always bears logic "1" to turn off the open collector type transistor even in the presence of signals at the terminals T and RT. Consequently, the capacitor 101 is allowed to be charged in order to ensure the normal initializing operation. The provision of the above circuitry in the reset line of the FF 151 as in this embodiment is inexpensive and simple. Alternatively, a signal may be applied to the signal line 103 independent of the CPG 95.

The signal line 61 or 62 connected to the input terminal PA 3 of the microcomputer has the role as will be described below. This signal line is essentially adapted to monitor the abnormal state of the partner microcomputer as described hereinbefore, but it is possible to eliminate the signal line 61 coupled with the input of the microcomputer 3. The microcomputer 3 normally receives no input signal at the input terminal IN but it receives an input signal when the microcomputer 1 becomes abnormal. Therefore, it is possible to utilize the reception of the input signal indicative of occurrence of the abnormal state of the microcomputer 1 for the sake of retrying the abnormal microcomputer 1. This method using an additional signal is rather time consuming for monitoring the abnormal state as compared with the embodiment described hereinbefore wherein the abnormal state can rapidly be monitored.

Turning to FIGS. 6 to 12, details of the program of the microcomputers 1 and 3 will be described. FIG. 6 is a flow chart to show the overall scheme of a software of the microcomputer 1 and FIG. 7 is a similar flow chart for the microcomputer 3.

A block 201 as shown in FIG. 6 indicates that when the input terminal $\overline{\text{RES}}$ of the MPU 81 assumes the change from logic "0" to logic "1", the ensuring blocks are executed. The initializing of the microcomputer 1 is first executed in block 203. Namely, registers in the MPU 81 are initialized, the PIAs 91 and 93 are initialized for preparing input and output settings, and data area in the RAM 85 is cleared in this block 203. In addition, the FF 151 of the retrial circuit is reset by the signal delivered from the output terminal PA1 of the PIA 93.

After initializing, the processing proceeds to block 205 to execute the sequence processing for the elevator. This processing includes well known processes such as for servicing the elevator in response to generated callings and will not be detailed herein.

Next, in block 207, the microcomputer 3 is monitored. More particularly, the input terminal PA 3 of the PIA 93 is examined and if the signal is present thereat, a program for retrial task to be described later is started to produce the signal from the output terminal PA 2 for retrial of the partner microcomputer 3 and recovery thereof to the normal state.

In block 209, the above fundamental flow is ended. Thereafter, block 211 provides a timer interruption (although not illustrated in the block diagrams of the hardware, an interruption signal by a timer is sent to the MPU 81 at a predetermined time interval) for monitoring the elevator sequence processing and the microcomputer 3.

In the event of occurrence of the abnormal state of the microcomputer 3, the retrial task is started in block 207, which task is a task of a lower preferential level than that in blocks 205 and 207 which is started by the timer interruption. More particularly, the retrial task is temporarily taken over, even in the course of execution thereof, by the coming timer interruption to proceed with blocks 205 and 207 and thereafter puts on the execution again.

In blocks 231 and 233 as shown in FIG. 7, the microcomputer 3 undergoes the same process as in block 201. The microcomputer 1 is monitored in block 235. More particularly, the presence or absence of the signal on the terminal PA 3 of the PIA 93 is examined. This examination is repeated until the presence of that signal is determined. When the microcomputer 1 becomes abnormal, the input and output units are switched from the microcomputer 1 to the microcomputer 3. Consequently, all the outputs are first cleared to completely stop the elevator. Thereafter, the stop position of the elevator is examined to produce, if the stop position is not normal, an instruction for moving the elevator to a normal position at which the elevator car door is opened. Then, the retrial circuit 15 associated with the microcomputer 1 is started and initialized. With successful completion of starting the microcomputer 1, the elevator restarts to move under the control of the microcomputer 1. Subsequently, the execution of block 235 is repeated. In the event of failure to start the microcomputer 1, the microcomputer 3 plays the part of the microcomputer 1 by processing with the same sequence processing as in block 205, thereby assuring continuous operation of the elevator.

Block 203 will now be described in more detail with reference to FIG. 8. Specifically, in accordance with the present embodiment, the initializing program contains control for the output terminal PA 1 of the PIA 93. Namely, the control program is such that immediately after block 251 executes delivery of logic "0" from the terminal PA 1, block 253 executes delivery of logic "1" to drive the one-shot pulse circuit 157 which in turn resets the FF 151. Due to the fact that the microcomputer has a machine cycle of 1 $\mu$S, the one-shot pulse circuit 157 having a higher operation speed can respond to the immediate delivery of logic "1". The above control program is not necessary for the initializing operation upon the closure of power supply but is dependently contained in the initializing program to meet universal utilization.

FIG. 9 shows details of block 207. In block 271, the presence or absence of the signal at the terminal PA 3 of the PIA 93 is examined. The result of block 271 is normally "NO" and the processing proceeds to block 277 and ends at block 209. In the case of "YES" indicating that the microcomputer 3 is in abnormal state, the retrial task has to be started. But, if the retrial task has already been started (determined by examining a starting flag), the result of block 273 is "YES" and the processing proceeds to block 277. If "NO", the processing proceeds to block 275 at which the retrial task is started. More particularly, restart task is executed in block 275 and the starting flag is raised. After the retrial task is started in block 275, the processing proceeds to block 277, thereby completing the processing associated with block 207.

FIG. 10 shows a flow chart for the retrial task processing program. When retrial task 300 is started by block 275, an abnormal hysteresis is examined in block 301. The examination in block 301 is necessary for limiting the number of the retrials in the event of occurrence of the abnormal state because unnecessary retrial for a runaway which occurs under a specified condition and for a runaway which occurs immediately after the elevator moves should be avoided. In this embodiment, the number of retrials is one and at the second retrial, an indication representative of failure of the microcomputer 3 is provided by block 315. When the failure indication is issued, a maintenance engineer makes a serviceability check. If the erroneous operation is found stationary, it is cured; but if accidental, the abnormal hysteresis stored in the microcomputer 1 is cleared and the failure indication is turned off. For the first occurrence of the abnormal state, block 303 executes production of the signal from the terminal PA 2 of the PIA 93 for retrial of the microcomputer 3 so that the retrial circuit 17 is operated. By this, the microcomputer 3 is initialized and stops delivering the output from the terminal PA 2 after time for initializing has elapsed. In block 303, the microcomputer 3 begins to operate and the FF 151 of the retrial circuit 17 is reset. A program of block 305 is adapted to wait for the complete commencement of the microcomputer 3. Thus, block 307 is executed after a predetermined time. Next, in block 307, the presence or absence of the signal at the input terminal PA 3 is examined. If the result of block 307 is "YES" indicating that the retrial is unsuccessful, the processing proceeds to block 315; but if "NO" indicating that the retrial is successful, the signal disappears and the processing proceeds to block 309 at which the present occurrence of the abnormal state is stored. Thereafter, block 311 produces a retrial task starting termination signal to be provided for block 273 (a flag indicative of the retrial task starting is reset). Finally, this task is completed in block 313. In this embodiment, when the retrial is unsuccessful, the processing directly proceeds to block 315. Alternatively, immediately after the retrial instruction is produced, the processing may be returned to block 303 and executed again. Also, in this embodiment, the frequency of retrial for the abnormal state is one and the abnormal state is cured by a maintenance engineer. But, no reoccurrence of the abnormal state after the predetermined time i.e., the absence of the input signal to the input terminal PA 3 after the predetermined time can be judged as an accidental trouble. In such a case, the abnormal hysteresis may be erased, thus eliminating the necessity of the maintenance upon the occurrence of the acidental abnormal state. The provision of the failure indication lamp for the output unit as in this embodiment may be altered for a location near the microcomputer and failure indication may be effected by the output from the PIA 93.

FIG. 11 shows details of block 235 contained in the software scheme of the microcomputer 3. In block 331, the abnormal state of the microcomputer 1 is examined by using the input signal to the terminal PA 3 of the PIA 93. In the absence of this input signal, the microcomputer 1 is judged as normal and the processing directly proceeds to block 347 and returns to the flow of FIG. 7. In the event of occurrence of the abnormal state, that input signal is present and the processing proceeds to the subsequent block 333. A program in this block 333 is for rescue of passengers in an elevator car, as will be detailed with reference to a flow chart of FIG. 12. When the microcomputer 1 becomes abnormal, passengers in an elevator car are trapped therein. Taking rescue of passengers into the most preferential consideration, this embodiment performs the retrial of the microcomputer 1 after the rescue. After cured once by the retrial, the microcomputer 1 may possibly become out of order immediately and there is a possibility of occurrence of such serious trouble that passengers face danger. Accordingly, in this embodiment, the retrial is intentionally effected only when an elevator car has travelled to a safe location. After the rescue program is completed, programs in blocks 337, 339, 341, 343 and 345 which are the same as those in blocks 303, 305, 307, 309 and 345 of FIG. 10 are executed. After the failure indication is issued by block 345, the microcomputer 3 plays the part of operating the elevator in accordance with a program in block 349. For effecting the same operation as the microcomputer 1, the same program as that of block 205 of FIG. 6 is employed. In this embodiment, the microcomputers 1 and 3 are equivalent to each other with respect to the input and output units so that the same program can advantageously be used. Subsequently, the program in block 349 is repeated. Recovery of the failure is achieved, in this embodiment, by a maintenance engineer who has watched the failure indication.

In the above explanation, the program of block 349 is the same as that of block 205 but it may be simplified. Namely, this program may be prepared as a common program to a variety of buildings and may include a program of minimized functions which are sufficient for an elevator to move independently. In this case, a large number of identical programs can advantageously be used and therefore, a mask ROM (which is an ROM written with a program during production of LSI) can be used at low cost. To reduce the density of functions, it is also possible to design the elevator controlling such that the elevator stops when the microcomputer 1 becomes abnormal. For example, upon occurrence of the abnormal state of the microcomputer 1, only the recovery operation and retrial of the microcomputer 1 may be effected and at the same time the sequence processing in block 349 may be stopped. In this case, the microcomputer 3 can extend its universal utilization and may comprise a one-chip-microcomputer. If block 333 is eliminated and only the direct retrial is involved, the utilization of the microcomputer 3 may further be extended.

Referring to FIG. 12, details of block 333 will be described. Following determination of the abnormal state of the microcomputer 1, block 333 intends to provide an expost facto processing wherein all the outputs are cleared to cancel out abnormal output signals which would be produced from the runaway microcomputer 1, thereby preventing an abnormal operation of the elevator. Subsequently, block 373 provides a predetermined time lapse and thereafter block 375 examines the present position of the elevator through the input unit 5. If the elevator is travelling at a high speed when the microcomputer runs away, the brake is actuated at the instance that all the outputs are cleared and the elevator stops after a predetermined time. The above predetermined time lapse is necessary for providing the time extending from the actuation of the brake to the complete stoppage of the elevator. Block 377 then examines whether or not the elevator stops at the end floor of the elevating path. If the elevator stops at the end floor, block 379 produces an instruction for moving the elevator in a direction opposite to the end floor but if not, block 381 produces a descending instruction. In accordance with this embodiment, the elevator travels at a low speed. After the elevator has started to move, it is expected that the first signal from the input unit 5, i.e., a stop signal for enabling the elevator to stop at the normal position of the floor is delivered. When this stop signal is received, the elevator operation is stopped. After stoppage, a door open instruction is delivered to open the elevator car door. The input unit 5 examines completeness of opening of the elevator car door. If complete, the processing reaches block 387 to return to the flow of FIG. 11. As will be seen from the above operation, in accordance with block 333, the elevator can stop safely at the nearest floor at which the elevator car door is opened to enable passengers to get off the car. If block 375 determines that the elevator stops at the normal position, the processing directly proceeds to block 385. If the elevator car door keeps unopened, block 383 executes to open the door.

In this way, according to this embodiment, when block 385 determines that the door is open, block 335 and ensuring blocks of FIG. 11 are executed. Such an execution of the above blocks after the stoppage of the elevator at the normal position and subsequent opening of the door can assure the safe retrial because even if the microcomputer 1 again runs away, the elevator is usually prevented from moving during opening of the door by means of a safety device other than the microcomputer system. An execution of block 335 and ensuring blocks at the termination of closure of the door following the door opening in accordance with block 333 and closure of the door at a predetermined time after opening of the door (when the elevator car is empty of passengers or after illumination in the car is turned off) can promote safety of the retrial.

As has been described in the foregoing, the embodiment of this invention comprises two microcomputers which constitute the control logic for the elevator and the retrial is exchanged between one microcomputer and the other microcomputer by detecting the abnormal state of the partner microcomputer, so that even when one of the microcomputers operates erroneously owing to affect of noise, the abnormal microcomputer can immediately be brought into recovery. Accordingly, the control system as a whole is extremely insensitive to noise and measures to cope with the noise are simplified. Also, the abnormal state detector circuit ensures that the other microcomputer is accessible to the retrial for the abnormal microcomputer only when the abnormal state is detected, so that an erroneous retrial by the microcomputer which is in abnormal state can be prevented, thereby promoting reliability of the control system. Moreover, the elevator is normally controlled by one microcomputer and in the event of occurrence of the abnormal state, the other microcomputer auxiliarily operates to rescue passengers. Accordingly, even when the one microcomputer actually becomes out of order and passengers are trapped in the elevator car, it is possible to immediately rescue the passengers.

This invention is in no way limited to the foregoing embodiment. For example, it is not always necessary to monitor the partner microcomputer but the retrial may be effected under different conditions. The retrial may be effected, for example, when the elevator stops at an inter-floor position or at a predetermined time interval. Conditions for the retrial may be prepared in a hardware manner. In the foregoing embodiment, when the microcomputer 1 becomes abnormal, the recovery operation toward the nearest floor is first effected and then the retrial is performed. Alternatively, immediately after confirming safe operation of the elevator, the retrial may be effected.

In general, a computer used for other systems than the elevator control such as for office work is insensitive to affect of noise and after the computer has once run away, contents treated by the computer immediately before or after the occurrence of the runaway are an important problem. Thus, it is necessary to analyze and correct the contents treated during occurrence of a runaway. In the elevator control, on the other hand, even when the control computer runs away, the subsequent controlling can be ensured by knowing the state of an object to be controlled, i.e., the elevator, irrespective of contents treated by the computer. This invention makes use of this nature of the elevator and provides one computer with retrial means for the other computer to thereby assure recovery of operation of the computer which runs away. This expedience is advantageously applied to the elevator control computer since erroneous operation of the computer is more due to noise than due to failure of the computer itself, and can minimize inoperative time of the elevator and provide highly reliable elevator services.

What is claimed is:

1. An elevator control system comprising an elevator servicing a plurality of floors in a building, and a control logic for the elevator including digital computers, wherein the control logic comprises a plurality of computers, and at least one computer is provided with means for retrial initializing the other computers.

2. An elevator control system according to claim 1 wherein each of the plurality of computers is provided with means for retrial initializing the remaining computers.

3. An elevator control system according to claim 1 wherein the computer with retrial initializing means comprises a computer which usually effects logic control for an object other than the elevator.

4. An elevator control system according to claim 1 wherein the computer with retrial initializing means executes monitoring processing for at least the remaining computers, and executes retrial initialization for the latter computers when detecting an abnormal state thereof.

5. An elevator control system according to claim 4 wherein the remaining computers are provided with means for detecting an abnormal state of their own, and the computer with retrial initializing means executes monitoring processing for said abnormal state detecting means.

6. An elevator control system according to claim 4 wherein the computer with retrial initializing means is provided with means for driving to at least a predetermined normal floor position the elevator which stops moving in the way of floors when the remaining computers become abnormal, and said computer with retrial initializing means retries after the elevator stops at the normal floor position.

7. An elevator control system according to claim 1 wherein the computer with retrial initializing means is provided with means counting the number of retrials for the remaining computers and stopping retrying when the frequency reaches a set value.

8. An elevator control system according to claim 1 wherein the computer with retrial initializing means retries the remaining computers on the condition that the elevator stops moving.

9. An elevator control system according to claim 1 wherein the remaining computers are provided with means for initializing when power supply circuit is closed, and drive the initializing means in accordance with a retrial initializing instruction from the computer with retrial means.

10. An elevator control system according to claim 1 wherein the control logic comprises two computers, and the two computers are provided with means for retrial initializing the partner computer.

11. An elevator control system according to claim 10 wherein at least one of the two computers executes logic control processing which is required to the extent that the elevator services in response to calls, and the other computer executes other logic control processings than the former.

12. An elevator control system according to claim 10 wherein at least one of the two computers is provided with means adapted to drive to the normal position of a predetermined floor the elevator which deviates from the normal position.

13. An elevator control system according to claim 10 wherein the two computer execute monitor processing for the partner computer and execute the retrial initializing when detecting an abnormal state of the partner computer.

14. An elevator control system according to claim 13 wherein the two computers are provided with means for detecting an abnormal state of their own and monitor the abnormal state detecting means of the partner computer.

15. An elevator control system according to claim 14 wherein the two computers execute initializing of their own by a retrial initializing instruction from the partner computer on the condition that the abnormal state detecting means of their own detects an abnormal state.

16. An elevator control system according to claim 10 wherein the two computers are provided with means for detecting an abnormal state of their own, and wherein there is provided means for switching input and output signals of one computer to the other when the abnormal state detecting means of the one computer detects an abnormal state.

17. An elevator control system comprising an elevator servicing a plurality of floors in a building, and a control logic for the elevator including digital computers, wherein the control logic comprises a plurality of computers, and at least one computer is provided with means for retrying the other computers, the computer with retrying means executes monitoring processing for at least the remaining computers, and executes retrial for the latter computers when detecting an abnormal state thereof, the remaining computers being provided with means for detecting an abnormal state of their own, and the computer with retrying means executes monitoring processing for said abnormal state detecting means, the remaining computers effect restarting of their own by an instruction from the computer with retrying means on the condition that said abnormal state detecting means detects the abnormal state.

18. An elevator control system according to claim 17 wherein said abnormal state detecting means comprises means for storing detection of the abnormal state, and the remaining computers are provided with means for resetting the storage synchronously with initializing for restarting.

19. An elevator control system according to claim 17 wherein there is provided a retrial circuit which produces a retrial signal for the remaining computers by the instruction from the computer with retrying means on the condition that the abnormal state detection is stored, and the remaining computers effect restarting in accordance with the retrial signal.

20. An elevator control system according to claim 19 wherein there is provided an one-shot circuit which resets the storage of the retrial circuit in accordance with a reset signal from the remaining computers.

* * * * *